United States Patent [19]

Price

[11] Patent Number: 5,040,443

[45] Date of Patent: Aug. 20, 1991

[54] MULTIPLE ANGLE MEASURING GAUGE

[76] Inventor: David T. Price, 648 Turnin St., S. St. Paul, Minn. 55075

[21] Appl. No.: 325,250

[22] Filed: Mar. 17, 1989

[51] Int. Cl.[5] ..... B27B 27/08

[52] U.S. Cl. ..... 83/468; 83/468.2; 144/253 R; 144/287; 269/304

[58] Field of Search ..... 83/467.1, 468, 468.1, 83/468.2, 468.4, 468.7, 468.3; 144/253 R, 287; 269/304

[56] References Cited

U.S. PATENT DOCUMENTS

| | | | |
|---|---|---|---|
| 3,059,674 | 10/1962 | Boling | 83/468 |
| 3,941,020 | 3/1976 | Huntley et al. | 83/468 |
| 4,111,409 | 9/1978 | Smith | 83/468.1 |
| 4,693,158 | 9/1987 | Price | 83/468 |
| 4,785,550 | 11/1988 | Wilkins | 83/468 |

OTHER PUBLICATIONS

Miter Master, Inc. Advertisement, 1989.
Clearmount Corporation Brochure, 1985.
Biesemeyer Manufacturing, Inc. Brochure, date unknown.
Pistorius Machine Co., Inc. Brochure, 1982.

*Primary Examiner*—Hien H. Phan
*Attorney, Agent, or Firm*—Merchant, Gould, Smith, Edell, Welter & Schmidt

[57] ABSTRACT

The present invention is a multiple angle measuring gauge and also a fence system which incorporates the stop mechanism. The stop mechanism has a body member which slides on the fence. A workpiece positioning member includes a rod and support for the rod. A workpiece head is cooperatively connected to one end of the rod for engaging the molding. The rod is releasably locked in relative position to the support means. The rod preferably has at least 2½ inches of travel and the rod is slideable on the support. A 90° ruler is cooperatively connected to a back member of the fence and a 45° ruler is cooperatively connected to a top surface of the bottom member of the fence.

10 Claims, 3 Drawing Sheets

MULTIPLE ANGLE MEASURING GAUGE

BACKGROUND OF THE INVENTION

1. Field of the Invention

This invention relates generally to a multiple angle measuring gauge and more particularly to a stop mechanism which incorporates a workpiece positioning means on a slide to provide for a versatile stop mechanism and also a fence system which incorporates the stop mechanism and one or more rulers.

2. Description of the Prior Art

The problem of cutting accurate mitres to length at various angles with a saw or cutting tool has been difficult to solve. To facilitate this process the table or fence portion of the saw is often lengthened and a ruled scale is fixed to it. Typically, two types of ruled scales are used to perform the measuring function. One type of rule which is used is the standard ruler where the graduations are marked with lines set perpendicular to the longitudinal axis of the ruler (herein referred to as a 90° ruler). Another ruler frequently used has the graduations set at a 45° angle to the longitudinal axis of the ruler. Each of these ruled scales solves some of the problems associated with mitring to length at an angle, but each also has its limitations.

The standard 90° ruler can be accurately set for any single angle, but on most cutting machines this setting will not be accurate for any other angle. The ruled scale set at a 45° angle to its longitudinal axis (hereafter referred to as a 45° ruler) will only work for 45° cuts, but it will allow measuring accurately at any point along the face of the angled cut. This solves a particular problem with mitre cutting, in that there are three general ways to measure the length of an angled piece of material. One may need to measure the piece from the long points of the angle outside measurement, or the shortest points (inside measurements) or at some point between the inside or outside length measurement (intermediate measurement). This last case, intermediate measurement, applies most specifically to the cutting of picture frames and the like. Moldings for making picture frames usually are made with a "rabbet" or cut-away step which allows the art work to fit inside of the picture frame molding to cover its edges and to hold it in place. The picture framer measures the art work and then must measure the picture frame molding "at the rabbet" to get a properly sized frame for the art work. Since the depth of the rabbet from the edge of the molding can vary considerably, a standard 90° ruler will not accurately measure moldings with differing rabbet depths, even though the angle stays the same unless the fence of the saw is specially modified. The 45° rule can do this, but not for any other angle. Another disadvantage of the 45° rule is that it can be more difficult to read than the standard 90° rule. To perform the task of measuring a 45° angle at any point including the edge of the rabbet, the rules must be as wide as the widest molding one would anticipate cutting. Generally these scales are made about four inches wide. Since moldings are measured directly against the 45° ruler, the ruled lines must extend completely across the ruler. These long lines become very hard to look at and accurately read if they are closer than ⅛" apart. Thus, the 45° scale is harder to read and more difficult to use for extremely accurate measurements than the 90° ruler. None the less, many picture framers prefer the 45° ruler because direct measuring against the rules can be less confusing, especially for the beginner. Both ruler types are useful for certain tasks, but these uses are quite limited.

Improvements have been made with these measuring methods by adding a stop mechanism to the ruled scale. The stop mechanism can solve problems that rulers alone cannot. The most basic function of the stop is to fix a position relative to the ruled scale so more than one piece of the same size can be cut without difficulty or loss of accuracy. Using a stop also allows more liberty when positioning the ruled scale, since the stop can have a position indicator relative to the scale (such as a hairline pointer) and a means for positioning the workpiece which are separated by some distance. An immediate advantage of this is that the ruler may be positioned where it is easiest to see (as disclosed in my patent, U.S. Pat. No. 4,693,158) and where it will be least affected by dust and wear. Stops currently on the market frequently have an adjustment means either in the form of an adjustable position indicator, or an adjustable means for positioning the workpiece which allows the operator to make adjustments in cutting accuracy without moving the rulers themselves (or both). (As described in U.S. Pat. No. 4,693,158). Stops have also been improved by having more than one adjustable position indicator, thus allowing it to be adjusted so more than one angle can be cut without needing to recalibrate the stop.

Currently on the market there are mitre cutting systems that use a 45° ruler and stop for making mitres and systems which use a standard 90° ruler to measure angled pieces to length. Of the systems that use the standard 90° rulers, some can cut 90° angles and 45° angles to length using two adjustable pointers (or position indicators) on the stop. One manufacturer makes one stop mechanism that measures 90° cuts or 45° cuts measured from the outside points, and another mechanism that measures 90° cuts or 45° cuts measured from the inside points. It is not possible to use the 90°–45° inside mitre stop to do the same work as the 90°–45° outside mitre stop.

Another manufacturer makes a system that will measure a 45° mitre at the rabbet with a standard ruler, but this requires removal of the fence for most saws and installation of a complicated clamping system to allow the molding to be cut safely.

While each of the above-mentioned systems solve some of the problems associated with cutting mitres at various angles to length, each falls short of providing a comprehensive solution to the problem. They are limited to working with one or two common angles (90° and 45°) and are designed to do generally symmetrical mitring. That is to say, that if the stop is set for a 45° inside mitre measurement, both ends must be 90° mitres., No provision is made for other angles such as 30° or 12½ even though such angles are used by craftsmen frequently in mitring. The purpose of my invention is to provide a stop mechanism and rule scale that is first of all, capable of being quickly adjusted to accommodate any angle, even if the angle to be cut on the other end of the molding is not symmetrically the same. This system may also include more that one adjustable position indicator. The stop mechanism could also be used with a standard 90° ruler or a 45° ruler or both rulers at the same time, thus allowing the operator to use the scale that offered the most advantage for the work involved. Because both scales could be used interchangeably, the operator would be able to check his work on both scales, thus having a second method to prove the work against.

An additional advantage of this improved stop system is applicable to picture framers and the like. As stated previously, these craftsmen measure the picture frame molding along the rabbet to accommodate the molding to the corresponding art work. Since the art work is frequently out of square or may have protruding nails or canvas along the edge, the framer generally adds a framing allowance or cutting allowance to the measurement of the art. A common allowance is ⅛", thus a 16" work of art would required a frame cut to 16⅛" at the rabbet. One a standard 90° ruler, this can lead to some confusing math, such as adding ⅛" to 15 15/16". The framer could more clearly see this measurement on the 45° ruler since he or she could position the rabbet edge directly on 15 15/16 and then advance the molding itself by ⅛". In one embodiment of the invention, the framer could position the molding on the 45° ruler at the proper measurement and advance it ⅛", and then move the stop until the hairline indicator was at 15 15/16" on the standard 90° ruler. With the stop locked in place on the fence of the saw, the means for positioning the workpiece can be unlocked and positions against the picture frame molding, which is position at 16 1/16 inches on the 45° ruler. Thus, the position indicator on the standard 90° ruler will read 15 15/16" while the actual molding is position at 16 1/16 on the 45° rule. The frame material will actually be cut at 16 1/16" (which can readily be seen on the 45° ruler) but the 90° ruler will read 15 15/16". Should the next measurement for the art work be 12⅜ inches, the framer can simply set the stop at 12⅜ inches on the 90° ruler without regard to the 45° ruler and the material will be properly sized at 12½ inches.

This invention addresses the problems associate with mitring various angles to length which have not been solved with previous mitring systems. This invention will accurately measure mitres of any angle along the inside mitre measurement (shortest point of measure), the outside mitre measurement (longest point of measure) or at any intermediate point along the face of the angle such as the rabbet. The proposed stop mechanism will work accurately whether used with the aforementioned 90° ruler, the 45° ruler, or both at the same time. It provides one or more ruler indicators which may be fixed or individually adjustable to determine the length of the material to be mitred. The means to adjust the workpiece positioning apparatus for various angles is easily and quickly operated by hand without the need for tools. After adjustment, the said workpiece positioning apparatus may be locked in place without fear of its positioning being altered by the mechanical action of the locking means. The unique design of the workpiece positioning means allows it to be used for the accurate positioning of material cut at any angle that can be cut with standard mitre saws or cutters 0° to approximately 50°). The stop mechanism workpiece positioning means has sufficient depth of adjustment to allow it to be adjusted for the full range of angles without alteration and in a single simply step. The stop is configured to work on each side of the saw without the need for additional parts or complicated adjustments. I believe no other mitre measurement system has addressed or solved these various problems in a single mechanism. In its various improved and unique elements this design provides a more elegant, comprehensive, and simple to operate solution to various mitring problems than any previous invention.

SUMMARY OF THE INVENTION

The invention is a multiple angle measuring gauge for use with a fence for power tools and cutting moldings. The stop mechanism includes a body member which is insertable on and removable from the fence and also for sliding on the fence. A workpiece positioning member includes a rod and means for slideably supporting the rod. The support means is cooperatively connected to the body member. A workpiece head is cooperatively connected to one end of the rod for engaging the molding. The head is configured to engage a variety of mitre angles. Further, the stop mechanism also includes a means for releasably locking the rod in position relative to the support means. In a preferred embodiment, the locking means includes a threaded shaft which, when rotated, causes the shaft to engage and thereby lock the rod in position. Further, the body member may have a view plate with one or more ruler indicators. Also, in a preferred embodiment, the rod has a travel of at least 2½ inches and preferably at least 3 inches.

In addition, the invention also includes a fence system for use with a power tool having a work surface. The fence system includes a generally planar elongated bottom member adapted to be secured to the work surface. A back member is cooperatively connected to the bottom member and a 90° ruler is cooperatively connected along the length of the back member. A 45° ruler is cooperatively connected to a top surface of the bottom member. A stop, as previously described, it utilized with the fence.

DETAILED DESCRIPTION OF THE INVENTION

Figure 1:
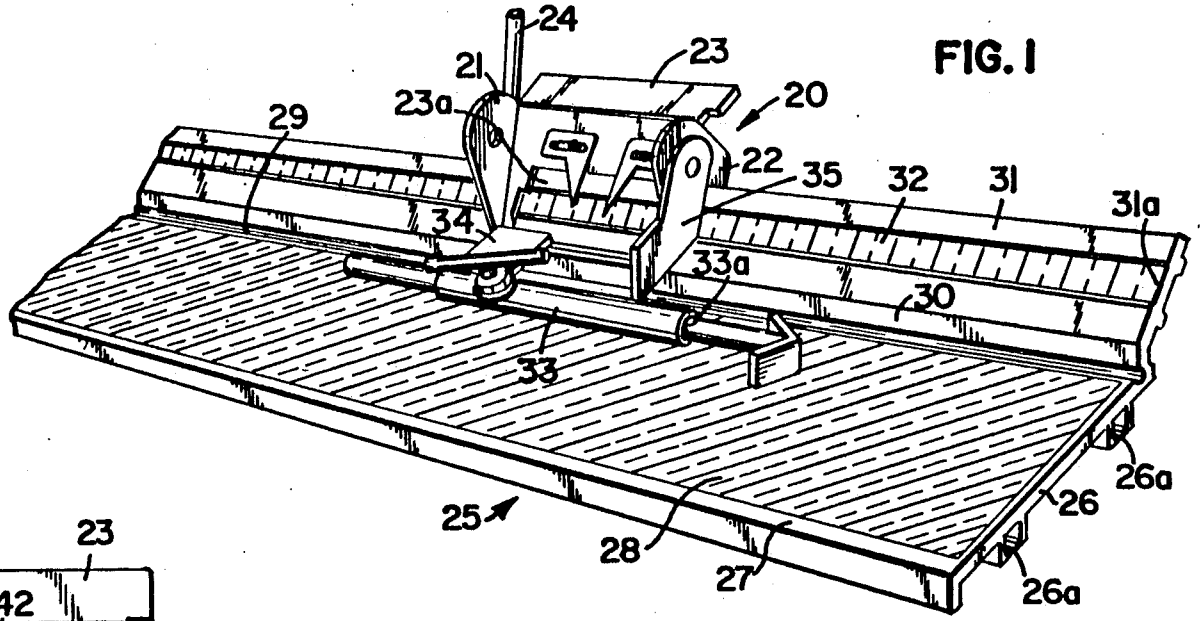
FIG. 1 is a perspective view of a fence system with a 45° rule, a 90° rule, and stop mechanism as constructed according to the principles of this invention.

Referring to the drawings, wherein like numerals represent like parts throughout the several views, there is generally disclosed at 20 a workpiece stop mechanism. The stop mechanism has a first generally C-shaped end plate 21 cooperatively connected to a second C-shaped end plate 22 by means of a top plate 23 to form the body of the stop mechanism 20. The end plates 21 and 22 may be cooperatively connected to the top plate 23 by any suitable means, such as welding. The top plate 23 has an opening, 23*a*. Lever 24 operates an eccentric locking mechanism, rotatingly mounted in the lower back portion of the end plates 21 and 22. The above described members are configured to operate in a similar fashion to the stop mechanism described in my earlier patent, U.S. Pat. No. 4,693,158, which is hereby incorporated by reference, and are of similar design.

This stop body mechanism may be slideably mated to fence 25 and locked into position with lever 24. The fence has a generally planar elongate bottom member 26. The bottom member 26 has bolt channels 26*a* extruded on its underside to enable the bottom member 26 to be secured to a working surface of a power tool or folding legs and connector mechanisms, such as one described in my earlier patent, U.S. Pat. No. 4,341,247, by means of bolts. The head of the bolt simply slides through the bolt channels 26*a* and then is fastened to the working surface (not shown). A flat surface 27 forms the table portion of the fence 25 and allows a self-adhesive 45° ruler 28 to be cooperatively attached. A sawdust groove 29 may be provided. An upright member 30, generally perpendicular to the bottom member 26, is cooperatively connected to the bottom member 26. An angled extension member 31 is cooperatively connected to upright member 30 and extends generally upward and away from upright member 30. The upright member 30 and extension member 31 are collectively referred to as a back member. A slot 31*a* is provided in the extension member 31 for receiving a measuring device such as 90° tape measure 32. Tape measure 32 could be slideably mounted in slot 31*a* or permanently secured with adhesive. A hollow sleeve member 33 is rigidly suspended above the flat surface portion 27 of fence body member 26 by horizontal plate 34 and side plate 35. Horizontal plate 34 forms a rigid connection between pipe member 33 and top plate 23 and is secured by any suitable means, such as welding. The pipe member 33 has a longitudinal bore 33*a* extending the length of the pipe member 33. Side plate 35 rigidly connects pipe member 33 to end plate 22 and is secured by any suitable means such as welding or bolting.

Figure 2:
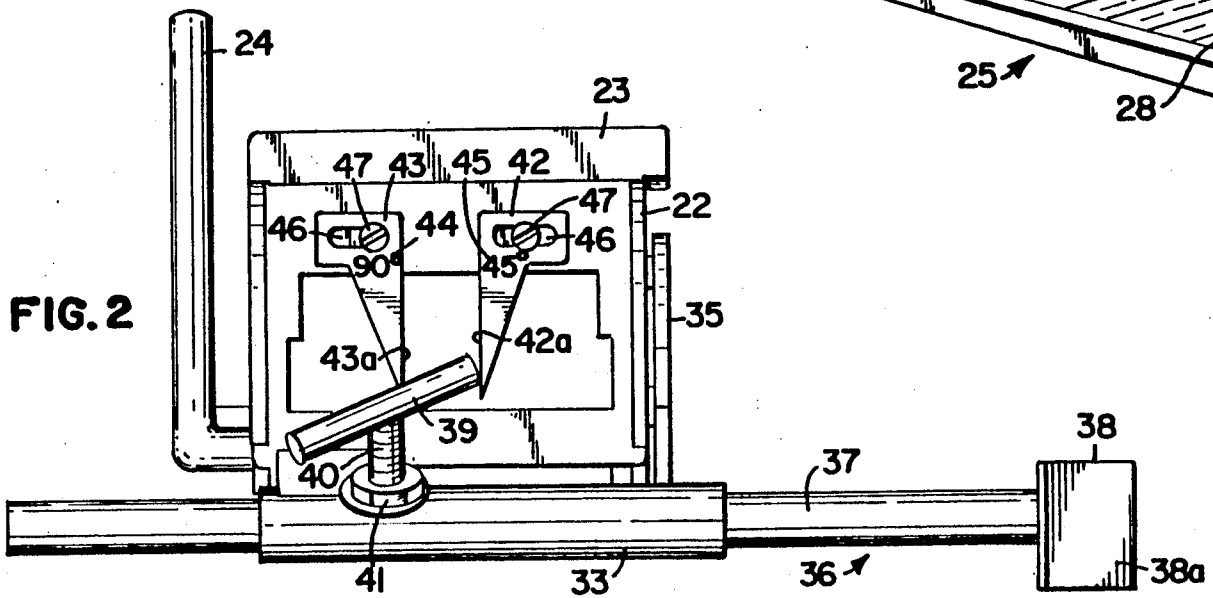
FIG. 2 is a top plan view of the stop mechanism as shown in FIG. 1.
Figure 9:
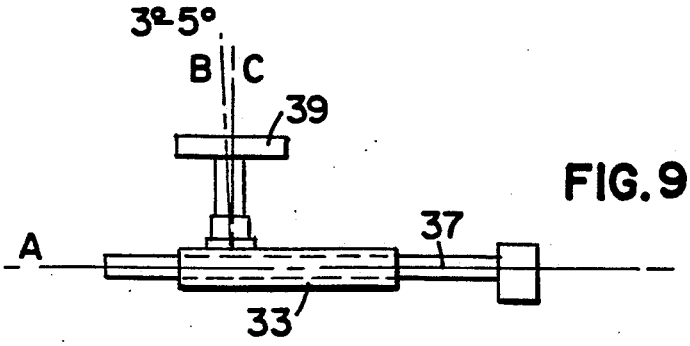
FIG. 9 is an enlarged view showing the offset engagement of the axis of the T-handle.

FIG. 2 shows a workpiece positioning member 36 comprising a rod 37, which is slideable inside bore 33*a*, and a workpiece positioned head 38. The workpiece positioning head 38 may be composed of two planar workpiece positioning faces 38*a* and 38*b* set at 90° to each other and cooperatively connected to rod 37 by suitable means such as welding. Each planar face of workpiece positioning head 38 would form an angle of approximately 45° in relation to the longitudinal axis of rod 37 when viewed from the top. The 45° positioning with respect to the axis allows the stop to be utilized with a variety of different mitres. The construction allows some portion of the molding to be cut to contact the surfaces 38*a* or 38*b*. Rod 37 is sized to slide within the bore 33*a* of pipe member 33. A T-handle 39 having a threaded shaft 40 is rotatable inside the threaded bore of nut 41. Nut 41 is cooperatively attached to hollow sleeve 33 by any suitable means such as welding. The bore of the nut 41 is positioned over an opening in the pipe 33, thereby forming a means for the shaft 40 to engage the rod 37. The T-handle is simply rotated and the threaded 40 engages rod 37 and holds the rod in position. It is important that the position of shaft 37, which is carefully set by the operator, is not changed when T-handle 39 is rotated to lock the position of the shaft in pipe member 33. If threaded shaft 40 engages rod 37 at a right angle, there is a slight tendency for shaft 37 to rotate a small amount before it is completely locked in place. By welding nut 41 to pipe member 33 at an angle so that the threaded shaft 40 engages shaft 37 at an angle of approximately 85° to 87°, the problem of rotation during locking is virtually eliminated. FIG. 9 shows the longitudinal axis B is at an angle to an axis C which is perpendicular to the longitudinal axis A of the shaft 37. By not having axis B intersect axis A at the right angle, rotation is virtually eliminated. While 85°–87° is preferred, it is understood that angles outside of this range may also be effective.

Adjustable ruler indicators 42 and 43 are used to mark the position of the stop on the 90° ruler for different types of mitres. Ruler indicators 42 and 43 have hairlines 42*a* and 43*a* respectively. The type of angle to be mitred may be indicated on the face of the ruler indicator as shown at 44 and 45. Each ruler indicator has an elongate slot 46 to allow for adjustment. Screws 47 each engage a threaded hole in top plate 23 and are tightened to lock the ruler indicators in place. The ruler indicators may be made of any suitable materials such as metal or clear plastic. Depending on the intended use of the stop, it may have one or more rule indicator. While the embodiment shown reveals a stop mechanism having a workpiece positioning member 36 that has a large amount of adjustment capacity (rod 37 has the ability to be adjusted in or out of the pipe member 33 approximately at least 2½ inches and preferably three inches or more) it is understood that the workpiece positioning means could have a small amount of adjustment if the ruler indicator could be adjusted approximately three inches or more. That is, either the ruler indicator 42 or the workpiece positioning means 36, or a combination of both, should be able to adjusted approximately 2½ inches or more for the stop to function optimally for measuring multiple angles on various common widths of molding. To function effectively, the locking mechanism for ruler indicator 42 or 43 would ideally be quickly adjustable by hand operation if said ruler indicator constituted the major adjustment means for the stop. In this case a T-handle or other locking handscrew similar to T-handle 39 might be employed in the place of screw 47 for locking the position of ruler indicator 46.

Figure 3:
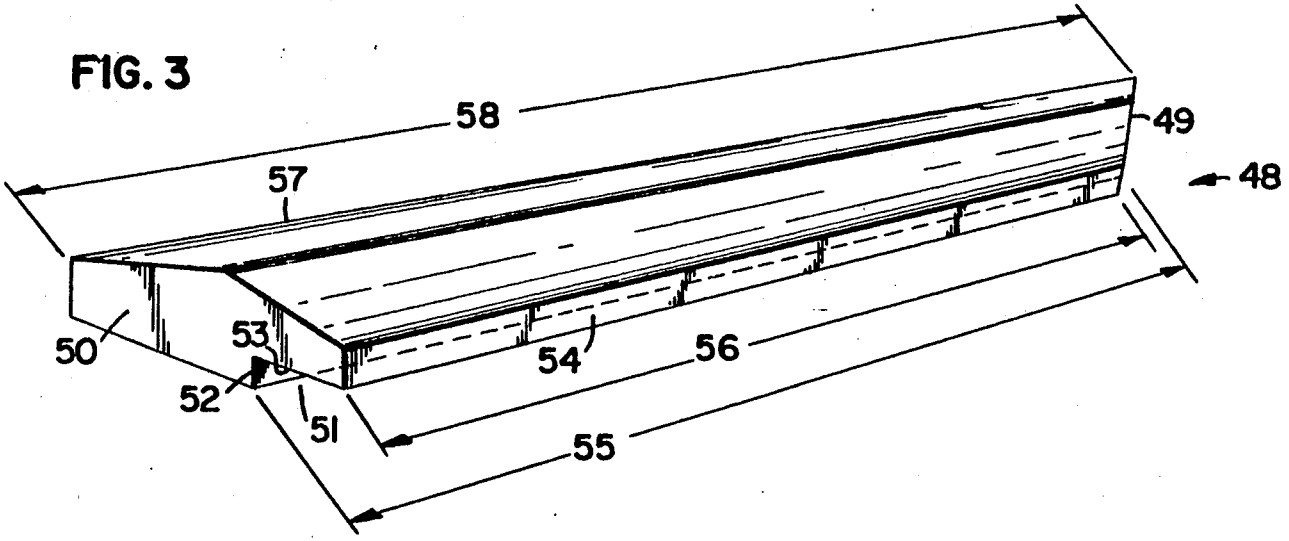
FIG. 3 is a perspective view of a length of a picture frame molding showing how the same piece of material may be measured from the different points.

FIG. 3 illustrates a length of molding similar to that used for picture framing generally indicated at 48. Mitred faces 49 and 50 have been mitred at 45°. A rabbet 51 having a vertical face 52 and a horizontal face 53 extends longitudinally along the inside face 54 of molding 48. Rabbit 51 is used in picture framing to cover the edge of the art work and to hold it in position in the frame. In picture framing the craftsman must size the frame to the art work and therefore measures the frame relative to the measurement "at the rabbet." This measurement is indicated at 55 and represents the distance between the vertical faces 52 of rabbet 51.

A workman might also measure along the inside face of the molding at 54 to get measurement 56, or the inside measurement. The outside edge of the molding may also be measured at 57 to the outside mitre measurement 58.

Figure 4:
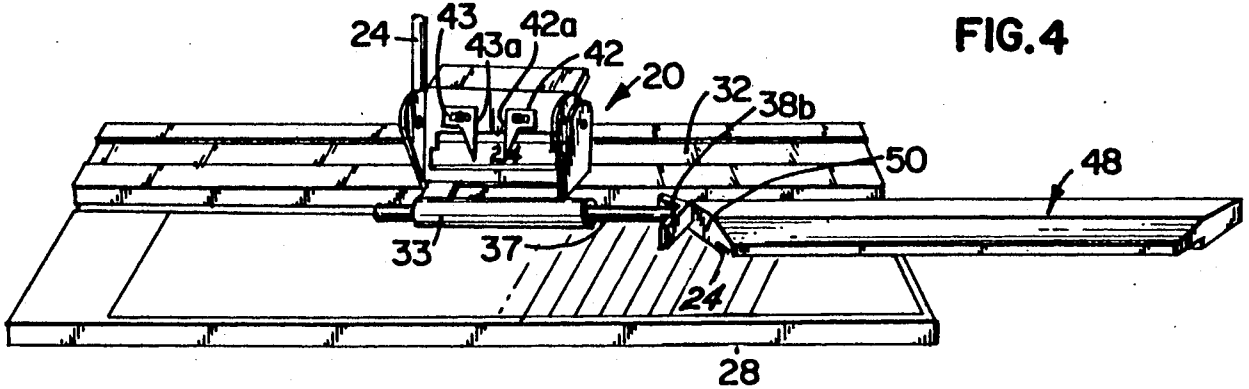
FIG. 4 is a simplified perspective view of the fence system shown in FIG. 1, demonstrating the positioning of a picture frame molding measuring 24 inches at the rabbet.

FIG. 4 illustrates a molding 48 properly positioned on 45° rule 28 to achieve a measurement of 24 inches at the rabbet. The T-handle has been removed for clarity, but the stop in FIG. 4 is identical to the stop 20 as fully shown in FIG. 1. The vertical face of rabbet 52 has been aligned with the 24 inch measuring line on the 45° rule 28. Stop 20 may now be advanced along fence 25 until the workpiece positioning means 36 contacts the molding 48. Stop 20 may then be locked in place with lever 24 and the molding may be mitred without regard to the 90° ruler 32. To calibrate the 90° ruler 32 to read accurately for the same mitre T-handle 39 is loosened to allow the workpiece positioning rod 37 to slide freely in bore 33*a*. The stop 20 is advanced along fence 25 until the ruler indicator 42 is aligned with the 24 inch graduation on the 90° ruler 32. Stop 20 is then locked on fence 25 with lever 24. The operator then advances workpiece positioning member 36 until a face 38*b* of workpiece positioning head 38 contacts mitred face 50. The operator then locks workpiece positioning rod 37 in pipe member 33 by rotating and thereby tightening T-handle 39.

Figure 5:
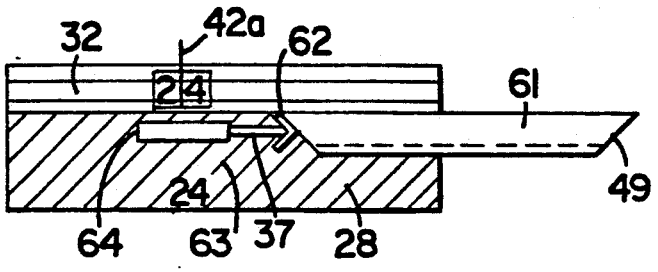
FIG. 5 is a further simplified top view of the fence system and the molding shown in FIG. 4, demostrating the position of the molding measuring 124 inches at the outside points.

FIG. 5 illustrates a molding 61 measuring 24 inches along the outside mitre measurement 58 as shown in FIG. 3. The outside point of the mitred face 62 is aligned with the 24 inch graduation 63 on the 45° ruler 28. For purposes of illustration, FIGS. 4-8 show only the hairline 42*a*, but it is understood that the entire stop 20, as shown in FIG. 1, is being utilized. The hairline 42*a* of stop mechanism ruler indicator 42 is shown in simplified form at 24 inches on the 90° ruler 32. Workpiece positioning member 36 has been advanced until the head 38 touches the mitred face of molding 48 and is locked in place with T-handle 39. Note that workpiece positioning rod 37 has been advanced to the right until its left end 64 is almost even with the end of pipe member 33.

Figure 6:
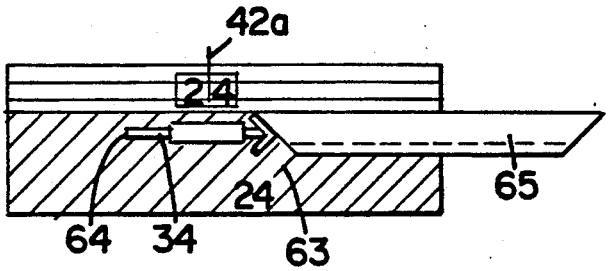
FIG. 6 is a simplified top view, as in FIG. 5, showing the molding positioned at 24 inches for an inside mitre measurement.

FIG. 6 illustrates a molding 65 positioned at the 24 inches graduation on the 45° ruler 28 for an inside mitre measurement as shown at 56 in FIG. 3. Note that when the 90° ruler indicator 42 is positioned on the 24 inch graduation for this type of mitre cut, the end 64 of workpiece positioning rod 37 has been moved a considerable distance to the left relative to its position in FIG. 5.

Figure 7:
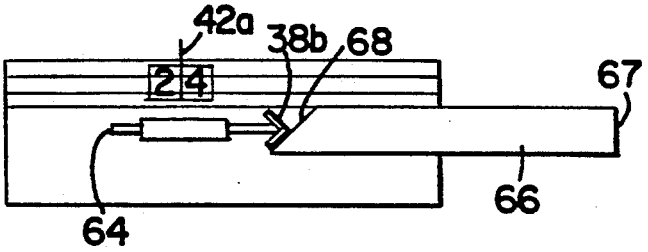
FIG. 7 is a simplified top view, as in FIG. 6, showing the measuring of a molding with asymmetrical mitres measuring 24 inches from the 90° mitre to the inside of the 45° mitre, with the 45° mitre reversed relative to the fence of the mitring table.

FIG. 7 illustrates how a molding 66 with asymmetrical mitres 67 (a 90° mitre) and 68 (a 45° mitre in reversed position relative to the other illustrations) can be mitred by adjusting the position of workpiece positioning rod 37 relative to the rule indicator 42*a*. The left end 64 is between the positions shown in FIGS. 5 and 6.

Figure 8:
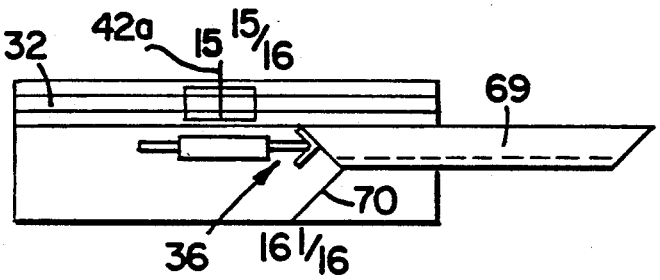
FIG. 8 is a simplified view, as in FIG. 7, showing the rabbet of the picture frame molding positioned at 16 1/16 inches at the 45° rule, while the stop mechanism is adjusted to read 15 15/16 on the 90° rule.

FIG. 8 illustrates the picture frame molding 69 that is measured with a ⅛ inch "cutting allowance." In this case the art work (not shown) measures 15 15/16 along the edge to be covered by the molding 69. The molding is advanced to the 15 15/16" graduation on the 45° ruler 28 and is then visually advanced ⅛" to 16 1/16" graduation 70. The stop 20 with workpiece position means 36 unlocked is advanced until the ruler indicator 42 is aligned with the 15 15/16" graduation on 90° ruler 32. Workpiece positioning head 38 is advanced until it contacts molding 69 and is locked in place. For subsequent measurements using the same type of molding, all measurements may be read directly from ruler 32, with the ⅛" cutting allowance already added on. All illustrations show cutting operations originating on the left side of the saw when viewed from the front. For use on the right side of the saw, the rules 28 and 32 would be mirror images of those on the left, and the workpiece positioning means 36 and ruler indicators 42, 43 (if more than one) would be reversed.

In its ideal embodiment, the workpiece positioning means and the ruler indicator would both have a large amount of adjustment capacity (about 2½ inches or preferably 3 inches each). To measure a 4 inch wide molding for an inside mitre, and then to adjust for an outside mitre for the same molding, would require an adjustment ability of almost 6 inches. If the workpiece positioning means had 6 inches of adjustment, it would tend to flex when fully extended, and would need to be machine with extreme accuracy to limit free play when in the unlocked slideable mode. If the ruler indicator were adjustable 6 inches, the stop itself would be of an unwieldy size, so a combination of adjustment ability would provide a workable mechanism of reasonable size. As a practical matter 2½ to 3 inches or more of adjustment is sufficient in the stop since the 45° ruler is usually made 4 inches wide and about 40 inches long. Thus, the 45° ruler handles moldings too wide for the 90° ruler adjustment to handle, and the 90° can handle moldings too long for the 45° ruler (the 45° ruler is difficult to manufacture in long lengths). While 3 inches of adjustment is not sufficient to handle very wide moldings, with the right combination of rulers it is adequate to handle the common run of mitring.

In addition, it is understood that the stop mechanism may also be sold as a kit so that the entire fence system need not be sold. The stop mechanism 20 may be sold with the ruler 32 and ruler 28 as a kit and the end user would utilize an appropriate fence purchased elsewhere.

Other modifications of the invention will be apparent to those skilled in the art in light of the foregoing description. This description is intended to provide specific examples of individual embodiments which clearly disclose the present invention. Accordingly, the invention is not limited to these embodiments of the use of elements having specific configurations and shapes as presented herein. All alternative modifications and variations of the present invention which follow in the spirit and broad scope of the appended claims are included.

I claim:

1. A fence system for use with a power tool having a work surface, said fence system comprising:

(a) a generally planar elongated bottom member adapted to be secured to the work surface;

(b) a back member cooperatively connected to said bottom member;

(c) a 90° ruler cooperatively connected along the length of the back member;

(d) a 45° ruler cooperatively connected to a top surface of the bottom member;

(e) a body member which may be placed on and removed from the back member and for sliding thereon;

(f) workpiece positioning member for use with a workpiece comprising:

(i) a rod;

(ii) means for slideably supporting said rod, said support means cooperatively connected to said body member;

(iii) a workpiece head cooperatively connected to one end of said rod for engaging the workpiece, said head configured to engage the workpiece which may have a variety of mitre angles;

(iv) calibrated scale means for the 90° ruler and the 45° rules;

(v) said rod being adjustable to allow the 90° ruler to be calibrated to the 45° ruler; and (g) means for releasably locking rod in position relative to said support means.

2. The fence system of claim 1, wherein said support means having an opening and a threaded shaft positioned in said opening whereby rotation of the threaded shaft causes the shaft to engage and thereby lock the rod in position, said shaft having a longitudinal axis.

3. The fence system of claim 2, wherein the longitudinal axis of said shaft does not intersect a longitudinal axis of said support means at a right angle.

4. The fence system of claim 2, wherein said workpiece head comprises a first and second face cooperatively connected and perpendicular to each other and each form a 45° angle to the longitudinal axis of said rod.

5. The fence system of claim 2, further comprising a threaded nut, having a bore, cooperatively connected to said support means over the opening of the support means said shaft being positioned in said threaded nut.

6. The fence system of claim 1, wherein said calibrated scale means comprising a ruler indicator.

7. The fence system of claim 6, wherein said ruler indicator is adjustable.

8. The fence system of claim 1, wherein said rod has a travel of at least 2½ inches in said support means.

9. The fence system of claim 8, wherein said travel is at least 3 inches.

10. An apparatus configured to be sold in kit form for forming, when assembled, a fence system for use with a power tool having a work surface, the fence having a generally planar elongated bottom member adapted to be secured to the work surface and a back member cooperatively connected to the bottom member, comprising:

(a) a 90° ruler cooperatively connected along the length of the back member;

(b) a 45° ruler cooperatively connected to a top surface of the bottom member;

(c) a body member which may be placed on and removed from the back member and for sliding thereon;

(d) workpiece positioning member for use with a workpiece comprising;

(i) a rod;

(ii) means for slideably supporting said rod, said support means cooperatively connected to said body member;

(iii) a workpiece head cooperatively connected to one end of said rod for engaging the workpiece, said head configured to engage the workpiece which may have a variety of mitre angles;

(iv) calibrated scale means for the 90° ruler and the 45° rules;

(v) said rod being adjustable to allow the 90° ruler to be calibrated to the 45° ruler; and (e) means for releasably locking said rod in position relative to said support means.

* * * * *